United States Patent [19]

Barker et al.

[11] Patent Number: 5,031,536

[45] Date of Patent: Jul. 16, 1991

[54] HIGH TEMPERATURE AND PRESSURE IGNITER FOR DOWNHOLE PERCUSSION CORING GUNS

[75] Inventors: James M. Barker, Katy; Martin L. Tomek, Houston, both of Tex.

[73] Assignee: Halliburton Logging Services, Inc., Houston, Tex.

[21] Appl. No.: 574,727

[22] Filed: Aug. 30, 1990

[51] Int. Cl.[5] ..... E21B 49/04; F42B 3/107; F42B 3/12; F42C 19/12

[52] U.S. Cl. ..... 102/202.5; 175/4

[58] Field of Search ..... 102/202.5, 202.7; 175/4

[56] References Cited

U.S. PATENT DOCUMENTS 4,339,947 7/1982 Wiley ..... 175/4
4,762,067 8/1988 Barker et al. ..... 102/202.7
4,944,225 7/1990 Barker ..... 102/202.5
4,979,576 12/1990 Barker et al. ..... 175/4

*Primary Examiner*—David H. Brown
*Attorney, Agent, or Firm*—William J. Beard

[57] ABSTRACT

An igniter is set forth in the present disclosure for use with a coring gun assembly. A bullet equipped with a bottom and having an O-ring thereabout is positioned in a chamber at one end thereof for firing to take a core sample. At the opposite end, an igniter is positioned in the chamber resting primarily on a shoulder aligning an elongate cylindrical shell within the chamber and having an external O-ring for sealing purposes. An elongate electrically insulated conductive firing pin extends through said shell so that an external circuit can be connected thereto to create a firing pulse. The current flows through the pin and through a bridgewire disc positioned at the end of the pin which in turn ignites a prepackaged cylindrical explosive charge to fire the bullet.

11 Claims, 1 Drawing Sheet

HIGH TEMPERATURE AND PRESSURE IGNITER FOR DOWNHOLE PERCUSSION CORING GUNS

BACKGROUND OF THE DISCLOSURE

After a well has been drilled and is an open hole but prior to casing the hole, one formation evaluation procedure involves taking core samples from the sidewall of the well. A coring gun assembly uses an explosive to fire a projectile into the sidewall to cut a cylindrical divot or core from the formation. The coring gun assembly is then retrieved to the surface with one or more cores captured in one or more projectiles, sometimes called barrels or bullets, and the cores are thus analyzed to determine whether or not hydrocarbons are present in them. Thus, the coring gun assembly is an elongate structure which fits in the open hole and which supports one or more bullets. Each bullet is received in a firing chamber and is supported for firing by means of an explosive mechanism behind the bullet. The bullet is supported on a slack retrieval cable so that the bullet is not lost. As wells become deeper and the explosives are exposed to hotter fluids in the well, the operating pressures become higher and the operating temperatures become more severe. Moreover, such explosives must be used in a sealed atmosphere to enable operation without wetting either the igniter charge or the main explosive charge. As these circumstances become more severe, it is more difficult to provide a rugged structure which is able to tolerate pressures as high as 20,000 psi and temperatures ranging up to 500° F. and yet provide a relatively simple mechanism which provides for safe firing. The present structure is such a device. As will be discussed in greater detail, the present structure provides an electrically fired mechanism. There is a protruding metal pin which is enclosed in a glass or ceramic sleeve fused to it to insulate the metal pin. The metal pin is received in a surrounding shell which enables all of the structure to be positioned in the coring gun at a firing chamber. More specifically, the metal pin connects with a bridge element disk of circular construction. It is positioned immediately adjacent to an electrically ignited explosive charge and that in turn is positioned adjacent to another explosive charge. The larger and last charge serves as the explosive propellant which fires the bullet from the chamber. It is especially important to provide this type of structure which operates in the rugged environment previously described because the structure is able to operate at high ambient pressures and temperatures without risk of accidental discharge or mechanical failure. Moreover, it is structurally simple and is able to be assembled with the coring gun assembly, the individual bullet, and the retrieval cables. More will be noted regarding this on a detailed discussion of the preferred embodiment which is set forth below.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
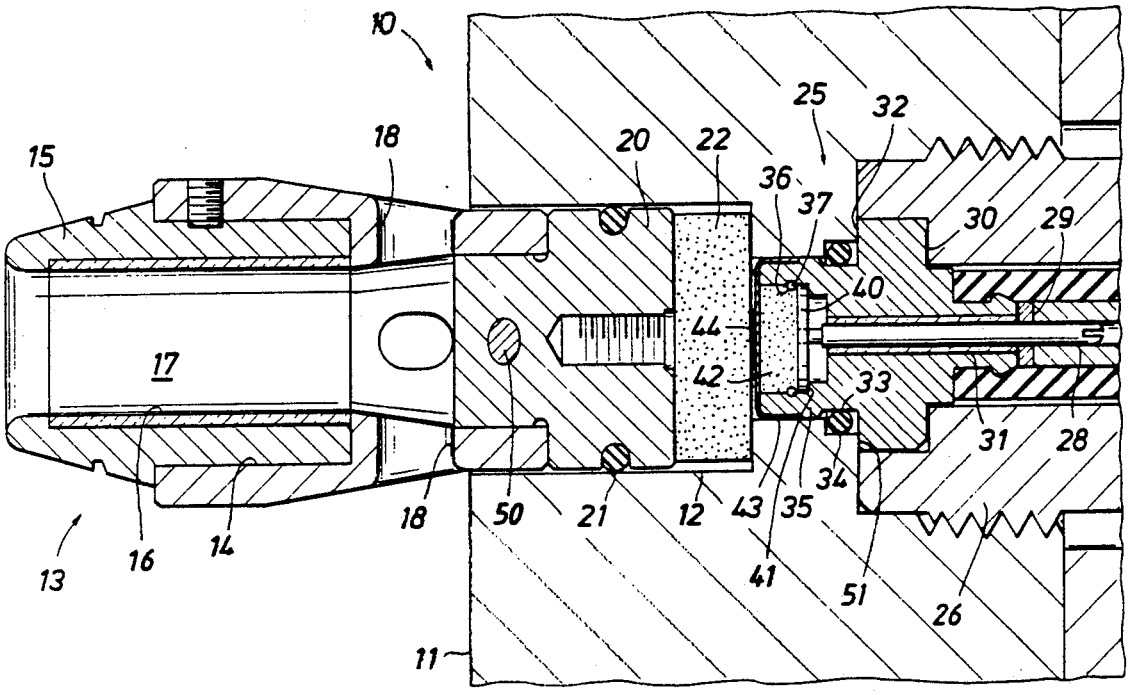
FIG. 1 shows a portion of a coring gun assembly supporting a bullet for firing into a formation to obtain a core sample and further including a main explosive charge for initiation by the igniter of the present disclosure.

A coring gun assembly supports one or more bullets. In FIG. 1 of the drawings, a portion of a coring gun assembly is generally identified by the numeral 10. This comprises an elongate metal body 11 constructed with one or more chambers 12 for supporting a bullet indicated generally at 13. A typical bullet is disclosed in U.S. Pat. No. 4,750,570, but other forms of bullets can also be used. As represented in that typical bullet disclosure, there is an outer body 14 which joins with a telescoping nose portion 15, and there is also an internal sleeve 16 in this particular embodiment. On the interior the sleeve provides an axially hollow chamber 17 for receiving and storing a cylindrical sample or plug which is cut by the bullet when it penetrates the side of the borehole. The bullet is anchored for retrieval by a cable (not shown) which is fed through and across the bullet at the ports 18 and the cable is anchored elsewhere on the elongate body 11 making up the coring gun assembly. The bullet is axially hollow, but it is closed at the back end by a bullet bottom 20 which is pin fastened 50 to the bullet body, and which is received in the firing chamber 12. An O-ring seal 21 is included to exclude or seal out well borehole fluids which might otherwise enter the firing chamber 12. The chamber 12 receives a packaged cylindrical explosive charge in the container at 22. In turn, that is ignited by the igniter 25 of the present disclosure. The igniter 25 is the entire subassembly which is positioned in the chamber 12 and which extends behind that chamber being held in place by a backing nut 26, or other suitable retaining means. The stepped diameters on the cylindrical igniter enable it to be clamped so that it protrudes into the chamber 12 and yet is held in position. Thus, the igniter assembly is retained between the shoulder 51 and the backing nut 26 in the fashion illustrated. This secures the igniter 25 in the necessary position to fire the bullet. As will be understood, the equipment shown in FIG. 1 can be replicated so that the coring gun assembly can support more than one bullet and they are fired at controlled depths in the well in a sequential fashion. The firing is controlled by electrical signals, or instructions, transmitted from surface equipment.

The igniter 25 should be considered in detail. This is a separate subassembly which is placed in the firing chamber 12 and which extends through the backup nut 26. It positions an exposed terminal for electrical connection. Moreover, the igniter is connected with suitable electrical conductors on the coring gun assembly which provide an electrical impulse to it of sufficient voltage and current for a sufficient interval to cause firing. For sake of clarity, those conductors have been omitted. One conductor, however, connects with a protruding metal pin 28 which is surrounded by a plastic or ceramic insulator disk 29 abutting the end of a metal shell 30. The shell completely surrounds the pin but does not contact it. Rather, they are separated or isolated by means of a fused glass or ceramic sleeve 31 which functions as an insulator. The metal shell has a protruding outer shoulder at 32 which assists at the time of installation. It has a reduced neck area 33 to receive the seal ring 34 which assures that well fluids do not leak into the firing chamber. The O-ring 34 is used as a seal as will be described in detail. The O-ring is positioned on the exterior of an elongate skirt 35 which has an internal groove 36 for receiving an internal retainer ring 37. The ring 37 snaps in place to hold a bridge element disk 40 in position. The disk 40 is a circular disk of finite thickness as will be described in detail hereinafter. The disk 40 electrically connects with the metal pin 28 which extends through the center of the metal shell 30 on the interior of the fused glass or ceramic sleeve 31. An electrical connection is provided through this route. A ground connection through the shell 30 is also provided by means of the disk 40 which grounds at the shoulder 41 which supports the disk.

The disk seats on the interior of the skirt 35 and thus defines a cylindrical chamber which is packed with powder at 42. The explosive 42 is a particular type explosive as will be defined. Moreover, it is placed in the skirt and sealed over by a transverse thin membrane 43 which seals to the skirt at a surrounding peripheral lip, and there is a central hole in it which is covered by means of a sacrificial adhesive sheet member 44. The latter can be a form of adhesive tape covering the opening in the center of the member 43.

The igniter 25 just mentioned and described in some detail is positioned immediately adjacent to the cylindrical plug 22 which is a compacted unitary explosive package. It either has the form of an impregnated plug of explosive materials or is a sealed and enclosed housing. Moreover, it is constructed with the diameter sized to fit within the firing chamber. It has a depth which enables registration of the various components; that is, the igniter is installed with the surrounding shoulder 32 which abuts the cooperative shoulder 51, and the O-ring 34 is compressed as the igniter is forced into the firing chamber 12. The igniter has a specified length from the shoulder 32; accordingly, it registers at a particular location and this enables the explosive cartridge 22 to be inserted. That in turn enables registration of the bullet. The bullet is constructed with the bottom plug which supports the surrounding seal ring 21. This thereby enables both of these components to plug into the firing chamber 12 and yet exclude the intrusion of fluids otherwise driven by prevailing pressures in the well. These pressures can reach as high as 20,000 psi. The bottom plug is limited in entry by a shoulder so that high pressure does not crush the bottom plug against the explosive cartridge 22.

The electrical signal path should be considered. A conductor from a firing mechanism is connected to the exposed tip of the metal pin 28. That protrudes from the equipment as shown in FIG. 1 and is exposed for connection with a suitable conductor and resilient cap. Electrical current flows along the pin to the opposite end. There, the current flows into the disk 40. Going now jointly to FIGS. 2 and 3, it will be observed that the disk 40 is constructed with a circular sheet of material which is preferably an insulating material such as printed circuit board material or ceramic. It is constructed with a surrounding external conductive lip 45. There is also an internal hole in the middle at 46. There is another hole at 47. That hole 47 connects with the encircling conductive metal strip 45 around the top and bottom faces. There is a flat bridge element 48 which spans the gap between the two holes 46 and 47. FIG. 3 shows the bottom side of the disc 40. Again as before, it is provided with an encircling peripheral strip 45. It is a conducting strip of metal. In conventional fabrication techniques, the metal strips applied to the top and bottom faces are constructed by well known printed circuit board manufacturing techniques for placing conductors in strip form on the disc. Alternately, the metal strips could be applied to a ceramic disc using sputtering, or metallization techniques. In summary, the disk supports a current conductor which is a wire or metal strap formed normally by plating and etching or deposition, sputtering, etc. The current conductor is called the bridgewire or element herein.

Figure 2:
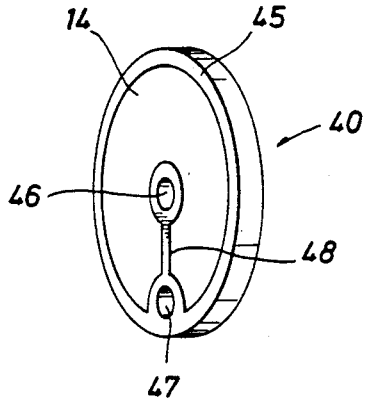
FIGS. 2 and 3 are opposite views showing opposite faces of a disk which is inserted into the igniter of FIG. 1.
Figure 3:
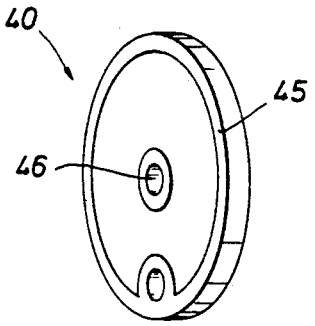

The present apparatus includes the two holes which are shown in FIGS. 2 and 3. The holes extend fully through the disc. The holes are plated through meaning metallized deposits are formed at both ends of the holes and on the interior of the holes. Accordingly, current can flow from one face of the disc to the other through the respective holes. Going now to the current flow path, it will be observed that a current pulse can be applied to the protruding and exposed pin 28. This current flows through the igniter 25. The current flows through the tip of the pin and into the centered opening 46 of the disc 40. Current flows along the hole in the disc and into the flat bridge conductor 48. This provides current flow through the bridge. The current flows through the narrow conductor 48 and then to ground. The current path to ground includes the back face of the disc as shown in FIG. 3, namely, the outer lip 45 and the metallic housing of the metal shell 30. This serves as a ground connection. The completes the circuit so that current is forced to flow through the narrow bridge 48, heating it above the ignition point of the explosive 42 to cause firing of the system.

Figure 4:
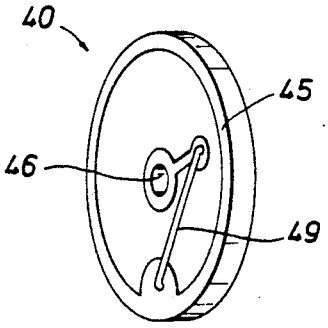
FIG. 4 shows an alternate construction of the igniter disk of FIG. 2 where a wire is used in contrast with a deposited bridge element.

FIG. 4 of the drawings shows an alternate embodiment which has a narrow wire bridge 49 which is connected in the same current flow path but which is physically deployed somewhat differently. It is a wire insert anchored in two eyelet openings and soldered in place. It again preserves the function of a bridge element which can be heated on application of a specific current to cause firing of the system.

The explosive which fills the chamber 42 is preferably a mixture of a secondary high explosive and oxidizer. The preferred secondary explosive is PYX, while the preferred oxidizer is potassium perchlorate. This is an explosive mixture which readily responds to the electrically heated bridge element and yet which is thermally stable for temperatures up to 500° F. for several hours. The explosive used in the main charge container can also be a mixture of PYX and potassium perchlorate, or any other suitable high temperature propellant.

While the foregoing is directed to the preferred embodiment, the scope thereof is determined by the claims which follow.

What is claimed is:

1. An igniter for use in a coring gun assembly for firing a bullet into the sidewall of a well to obtain a core sample therein wherein the igniter comprises:

(a) an outer elongate structural shell formed of a conductive material and having an outer exposed end;

(b) an electrically insulated conductive pin extending from the exposed end to an opposite end of said shell to provide current flow from an external firing source;

(c) a protruding cylindrical skirt affixed to said metal shell at the opposite end;

(d) mounting means supporting a bridge element for creating electrical ignition on passing a current through said pin wherein the current flows through said bridge element, and further wherein said skirt is sized to receive an explosive therein for ignition by said electrically heated bridge element;

(e) sealing means for sealing the explosive; and (f) external seal means for sealingly positioning said shell within a firing chamber of a coring gun assembly to exclude well borehole fluids from entry into said chamber so that a bullet may be positioned in said chamber to be propelled upon firing of said explosive in said igniter.

2. The apparatus of claim 1 wherein said protruding cylindrical skirt is affixed to said metal shell at the opposite end thereof, and between the ends thereof a protruding encircling shoulder on said shell registers said skirt within said chamber.

3. The apparatus of claim 1 wherein said structural shell is formed with a circular surrounding peripheral shoulder extending radially outwardly therefrom and said shoulder abuts a structural member of said coring gun assembly wherein said chamber is formed as a cylindrical opening into said member.

4. The apparatus of claim 1 wherein said skirt has an O-ring mounted on the exterior thereof which comprises said external seal means, and further wherein said O-ring fits within the firing chamber to seal thereagainst; and further including a cooperating spaced O-ring supported on a bullet positioned in said chamber so that said chamber is pressure isolated at the interior thereof.

5. The structure of claim 4 wherein said first and second O-rings are compressed and sealed against the surrounding chamber, and said coring gun assembly is comprised of a first member having said chamber formed therein and including a separate retaining member which contacts said outer elongate structural shell to clamp and hold said shell in position within said chamber without movement at the time of firing.

6. The apparatus of claim 1 wherein said explosive is a mixture of a secondary explosive and the oxidizer potassium perchlorate.

7. The apparatus of claim 6 wherein said secondary explosive is PYX.

8. The igniter of claim 1 wherein said mounting means comprises a circular disc of nonconductive material having conductive means thereon for electrically engaging said conductive pin, a serially connected bridge element, and conductive means serially connected from said bridge element to said metal shell for grounding.

9. The apparatus of claim 8 wherein said disc is received within said skirt, and said explosive sealing means has the form of a covering over said skirt to confine said explosive therein.

10. The apparatus of claim 9 further wherein said explosive sealing means comprises a transverse membrane over said skirt for enclosing said explosive on one side thereof and further including a hole in said membrane wherein said hole is covered by a sacrificial adhesive sheet.

11. The apparatus of claim 10 wherein said explosive sealing means comprises a circular and cylindrical tubular means extending over said skirt and sealing thereagainst, and further including a retainer ring positioned within said skirt for holding said mounting means and supported bridge element within said skirt immediately adjacent to said explosive.

* * * * *